US006029954A

United States Patent [19]

Murdaca

[11] Patent Number: 6,029,954

[45] Date of Patent: Feb. 29, 2000

[54] RAILING ASSEMBLY

[76] Inventor: Domenico Murdaca, 1980 Le Chatelier, Laval, Quebec, Canada, H7L 5B4

[21] Appl. No.: 09/027,303

[22] Filed: Feb. 20, 1998

[30] Foreign Application Priority Data

Mar. 18, 1997 [CA] Canada ..... 2200265

[51] Int. Cl.[7] ..... E04H 17/14

[52] U.S. Cl. ..... 256/59; 256/65; 256/24

[58] Field of Search ..... 256/59, 65, 68, 256/21, 22, 24

[56] References Cited

U.S. PATENT DOCUMENTS

| | | | |
|---|---|---|---|
| 2,870,996 | 1/1959 | Helt . | |
| 3,033,532 | 5/1962 | McFall . | |
| 3,756,567 | 9/1973 | Murdock | 256/21 |
| 3,770,245 | 11/1973 | Murdock | 256/24 |
| 3,918,686 | 11/1975 | Knott et al. | 256/21 X |
| 4,014,520 | 3/1977 | Walters | 256/59 X |
| 5,200,240 | 4/1993 | Baker | 256/59 X |
| 5,649,688 | 7/1997 | Baker | 256/21 |

FOREIGN PATENT DOCUMENTS

| | | | |
|---|---|---|---|
| 2257985 | 6/1973 | Germany | 256/21 |
| 2058168 | 4/1981 | United Kingdom | 256/65 |

*Primary Examiner*—Lynne H. Browne
*Assistant Examiner*—John R. Cottingham
*Attorney, Agent, or Firm*—George J. Primak

[57] ABSTRACT

A railing assembly is provided where the upper railing and the lower railing are interconnected with suitable cross-bars or plates and siding strips are snapped-on and locked on the sides of the railings to cover the opening and/or the ledge in the upper and lower railings and generally to strengthen and enhance the appearance of the railing assembly. Kits are also included within the scope of this invention for installing such railing assembly in conjunction with porches, stairways and the like.

14 Claims, 4 Drawing Sheets

RAILING ASSEMBLY

BACKGROUND OF THE INVENTION

1. Field of the Invention

This invention relates to a railing assembly, for instance made of aluminum, which has upper and lower railings interconnected by spaced apart vertical bars pivotably fastened at each end to each railing so that the structure may be adjusted to a desired angle. The railings may also be interconnected by means of suitable plates or panes.

2. Brief Description of the Prior Art

Railing assemblies are well known. They normally comprise an extended or otherwise fabricated upper and lower railings interconnected by spaced apart cross-bars which may be pivotably fastened at each end within U-shaped channels provided in each railing. This allows the adjustment of the railings to various angles when they are used on the side of the stairway or the like. The railings may also be interconnected by means of suitable plates or panes. The upper railing is normally provided with an uppermost smooth surface suitable for holding with a hand. Such railing assembly may be installed both inside and outside of a house. Vertical posts are also usually provided for connecting sections of the railing assembly as may be required by the dimensions of the porch, balcony, stairway or the like.

One major problem with such known railing assembly is that the upper and lower U-shaped channels are usually left open. This leads to an accumulation therein of dust, dirt, insects and the like, particularly when the railing is outside of the house. Because the channels are fairly narrow and interconnected by spaced apart vertical bars or the like, they are difficult to clean and for this reason, many home owners avoid such railings. Sometimes the U-shaped channels are covered with suitable covers, but this must be done section by section fitting the covers between the vertical bars and somehow fastening them without affecting the overall appearance of the railing. This is labor intensive and costly and cannot be readily performed by an average home owner. Also, rivets or other fastening means are usually visible on the sides of such railings, which adversely affects their ornamental appearance.

OBJECTS AND SUMMARY OF THE INVENTION

It is an object of the present invention to obviate the above disadvantages and to provide a railing assembly where the longitudinal channels provided within the upper and lower railings can be readily closed.

A further object of the invention is to provide a railing kit with appropriate elements for a simple and efficient installation of the railing assembly.

Other objects and advantages of the invention will be apparent from the following description thereof.

In essence, the invention provides a railing assembly comprising an upper railing and a lower railing made of a suitable metal, such as aluminum, each railing having a longitudinal channel therein, and means are secured within these channels adapted to interconnect the railings with one another, and also siding strips are provided which are preferably made of metal, such as aluminum, and which are adapted to be snapped on and locked on each side of each railing, each said siding strip having an inwardly projecting flange at one of its edges such that when two siding strips are locked on opposite sides of a railing, their flanges serve to substantially fully cover any opening or ledge of the longitudinal channel. The means adapted to interconnect the railings with one another may, for example, consist of a plurality of spaced apart cross-bars pivotably fastened at each end to each railing within the longitudinal channel of each railing, or of suitable plates or panes which may be made of a desired material, such as metal, plastic, fiberglass and even glass. The longitudinal channels are usually U-shaped and provide suitable space to insert and secure within said channels the interconnecting means, such as suitable cross-bars or plates. The cross-bars are normally made of the same metal as the railings and are pivotably connected to the railings by means of rivets, whereas the plates may simply be inserted into the channels to be held and secured thereby.

The most essential feature of the present invention resides in the provision of siding strips to cover the sides of the railings as well as the openings produced by the longitudinal channels. In the case of the upper railing, such opening is at the bottom end of the railing, whereas in the case of the lower railing, it is at the top end of the railing. The siding strips are thus provided with inwardly projecting flanges which, when the siding strips are locked on the railings, will jointly substantially fully cover the channel openings. The outer edges of the flanges are adapted to meet and touch one another, thus providing a cover for the channel opening.

When cross-bars are used to interconnect the railings, these bars, which are usually hollow, are mounted with their ends in the respective channels and are fastened by riveting them within these channels. The rivets, therefore, project through the sidewalls of the railings and through the respective ends of the cross-bars, thereby making the cross-bars pivotable around said rivets. In this manner, the cross-bars not only interconnect the railings, but may also adjust them to a desired angle, which is required when such railings are used in association with stairways or the like. However, when such cross-bars are used, the flanges on the siding strips are provided with appropriate cutouts in order to accommodate said cross-bars. The cutouts have a size and shape such as to essentially surround the bars when the siding strips are locked in position. Since the cross-bars are normally spaced apart at an identical predetermined distance, the cutouts can also be made at such distance and be essentially identical. The siding strips themselves will, therefore, also normally be identical for any given railing assembly, which facilitates their manufacture.

In order that the siding strips may be snapped-on and firmly held or locked on the sides of the railings, a second flange is preferably provided at the edge opposite to the edge with the flange serving to cover the opening and/or ledge of the longitudinal channel. Also suitable groves and ribs are provided within the siding strips and on the railings to achieve the snap-on locking. It should also be pointed out that any arrangement to provide snap-on locking of the siding strips on the sides of the railings would be appropriate for the purposes of the present invention.

The preferred embodiment of this invention provides an aluminum railing assembly comprising: an upper railing and a lower railing made of aluminum, each railing having a generally U-shaped longitudinal channel; a plurality of spaced apart aluminum cross-bars pivotably fastened at each end to each railing within the U-shaped channels; and aluminum siding strips adapted to be snapped-on and locked on each side of each railing, each said siding strip having an inwardly projecting flange such that when two siding strips are locked on opposite sides of a railing, their flanges cooperate to substantially fully cover the opening of the U-shaped channel, said flanges being provided with cutouts in the places where they meet the cross-bars when the siding strips are locked onto the sides of the railings, said cutouts having a size and shape such as to essentially surround the cross-bars. The various aluminum pieces may be anodized or painted and thus provided in different colors for ornamental purposes.

Moreover, the invention also includes a railing assembly kit comprising:

(a) a structure consisting of an upper railing and a lower railing made of a suitable metal, such as aluminum, each railing having a longitudinal channel therein, and a plurality of spaced apart cross-bars also made of a suitable metal, such as aluminum, pivotably fastened at each end of each railing within the longitudinal channel of each railing;

(b) siding strips made of a suitable metal, such as aluminum, adapted to be snapped-on and locked on the sides of the railings, said siding strips having inwardly projecting flanges serving to substantially fully cover the opening of the longitudinal channel when said siding strips are locked on each side of each railing, said flanges having cutouts in places where they meet the cross-bars when the siding strips are locked onto the sides of the railings, said cutouts having a size and shape such as to essentially surround the cross-bars; and (c) end-posts and intermediate posts made of a suitable metal, such as aluminum, to which predetermined sections of said structure are adapted to be connected, each of said posts being provided with a base capable of being firmly attached to the floor where the railing assembly is to be installed.

When reference is made of a suitable metal for the various pieces, this refers to a metal that is sturdy enough to be used for a railing assembly, but light enough for the purposes of transport and inexpensive enough for purposes of home renovation and the like. Aluminum is an ideal metal for this purpose, but steel and various alloys could also be used. Moreover, because the cross-bars are pivotable, during transport they may be pivoted fully to bring the upper and lower railings as close as possible to each other, resulting in the saving of space.

An alternative railing assembly kit may comprise:

(a) an upper railing and a lower railing made of a suitable metal, such as aluminum, each railing having a longitudinal channel therein;

(b) end-posts and intermediate posts made of a suitable metal, such as aluminum, to which predetermined sections of said railings are adapted to be connected, each of said posts being provided with a base capable of being firmly attached to the floor where the railing assembly is to be installed;

(c) suitable plates adapted to be inserted by their top and bottom ends into the longitudinal channels of the upper and lower railings respectively to be firmly held therein and thereby interconnect said railings; and (d) siding strips made of a suitable metal, such as aluminum, adapted to be snapped-on and locked on each side of each railing, each siding strip having an inwardly projecting flange such that when two siding strips are locked on opposite sides of a railing their flanges serve to cover side ledges of each longitudinal channel.

Obviously, the kits may also comprise various screws, brackets, nuts and bolts required to fasten the various pieces to one another and to fasten the posts to the floor. They may also comprise the tools required for this purpose and/or to cut predetermined sections of the railing assembly to fit a porch, balcony, stairway or the like.

BRIEF DESCRIPTION OF THE DRAWINGS

The invention will now further be described with reference to the appended drawings, in which.

DETAILED DESCRIPTION OF THE INVENTION

In all figures the same elements are designated by the same reference numbers.

Figure 1:
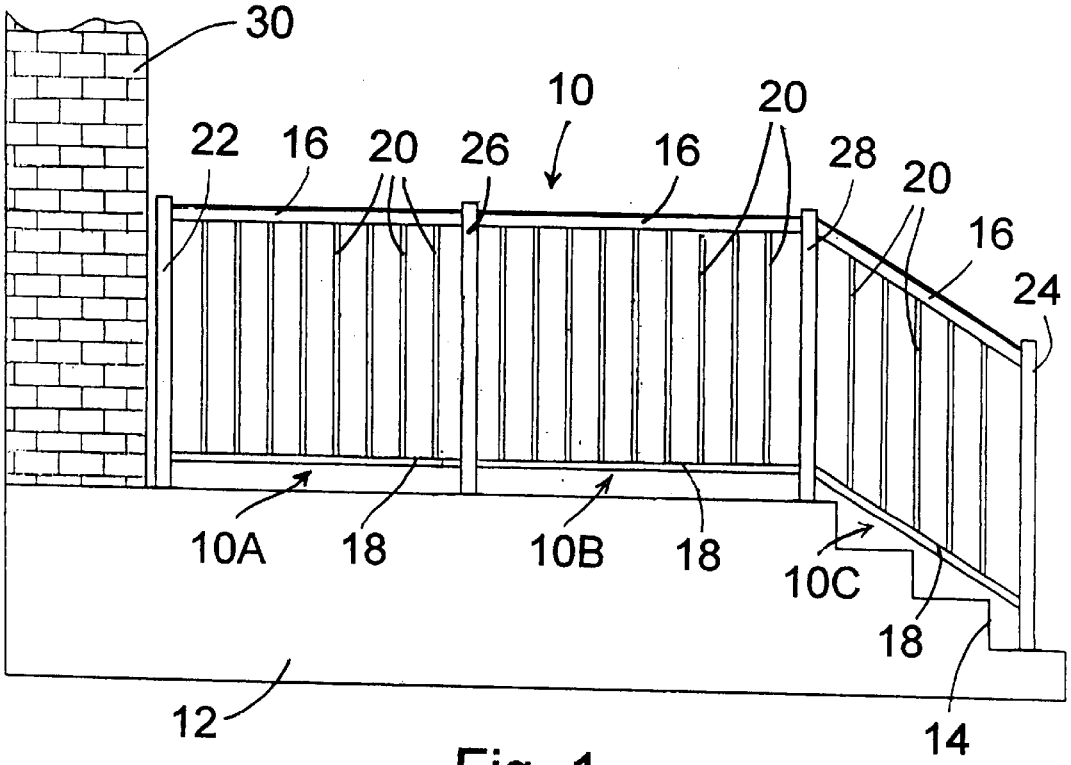
FIG. 1 is a side view showing an installed railing assembly having spaced apart cross-bars between the upper and lower railings.

Referring to FIG. 1, it illustrates an installed railing assembly 10 comprising three sections 10A, 10B and 10C. The railing assemblies of sections 10A and 10B are installed on a horizontal floor of porch 12 and the railing assembly 10C on the stairway 14 leading to said porch. Each section of the railing assembly comprises an upper railing 16 and a lower railing 18 as well as spaced apart cross-bars 20 interconnecting said railings. The cross-bars 20 in sections 10A and 10B are perpendicular to the railings whereas in section 10C they are at an angle to the railings which themselves are at an angle to the horizontal that depends on the slope of the stairway. End posts 22 and 24 and intermediate posts 26 and 28 are also provided to hold the railings solidly in place. In lieu of the end post 22, the railing could also be attached directly to the wall 30.

Figure 2:
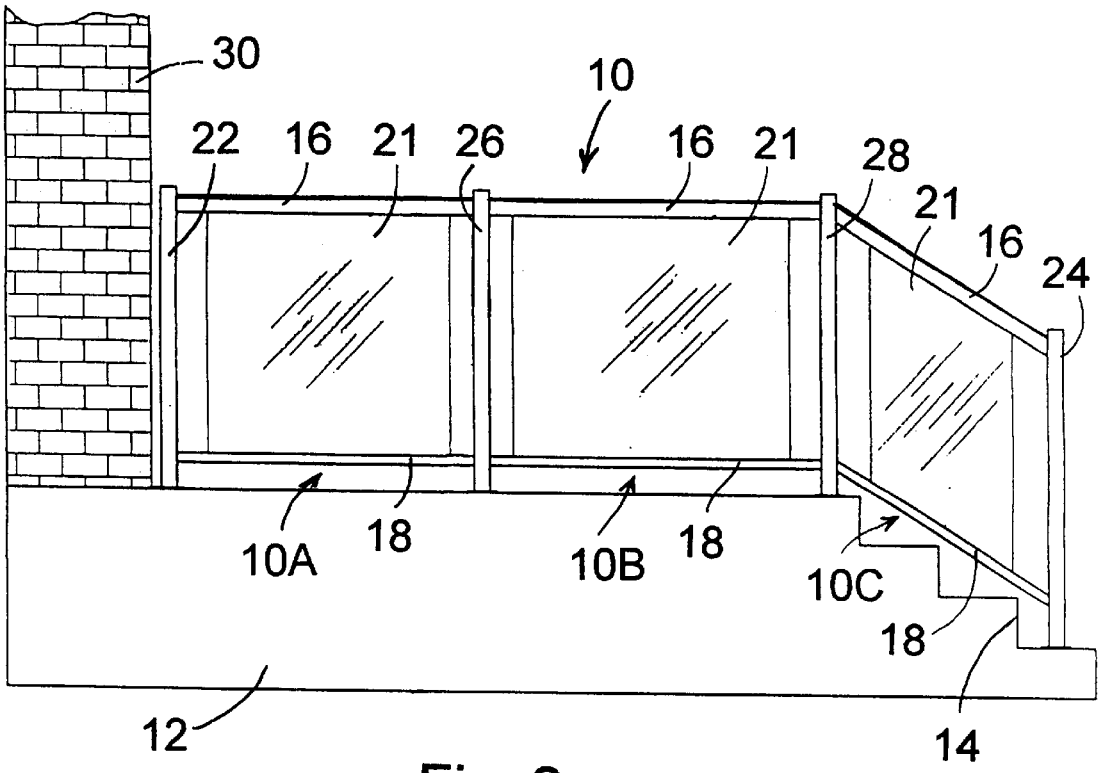
FIG. 2 is a side view showing an installed railing assembly having plates or panes between the upper and lower railings.

In FIG. 2 a similar installation as that shown in FIG. 1 is provided, however, in lieu of spaced apart cross bars 20, there are provided plates 21 interconnecting the upper and lower railings. Upper railings 16, lower railings 18, cross-bars 20, posts 22, 24, 26 and 28 may all be made of a metal such as aluminum or aluminum alloy which may be painted or anodized. Plates 21 may be made of any suitable material, including plastic or non-shattering glass.

Figure 3:
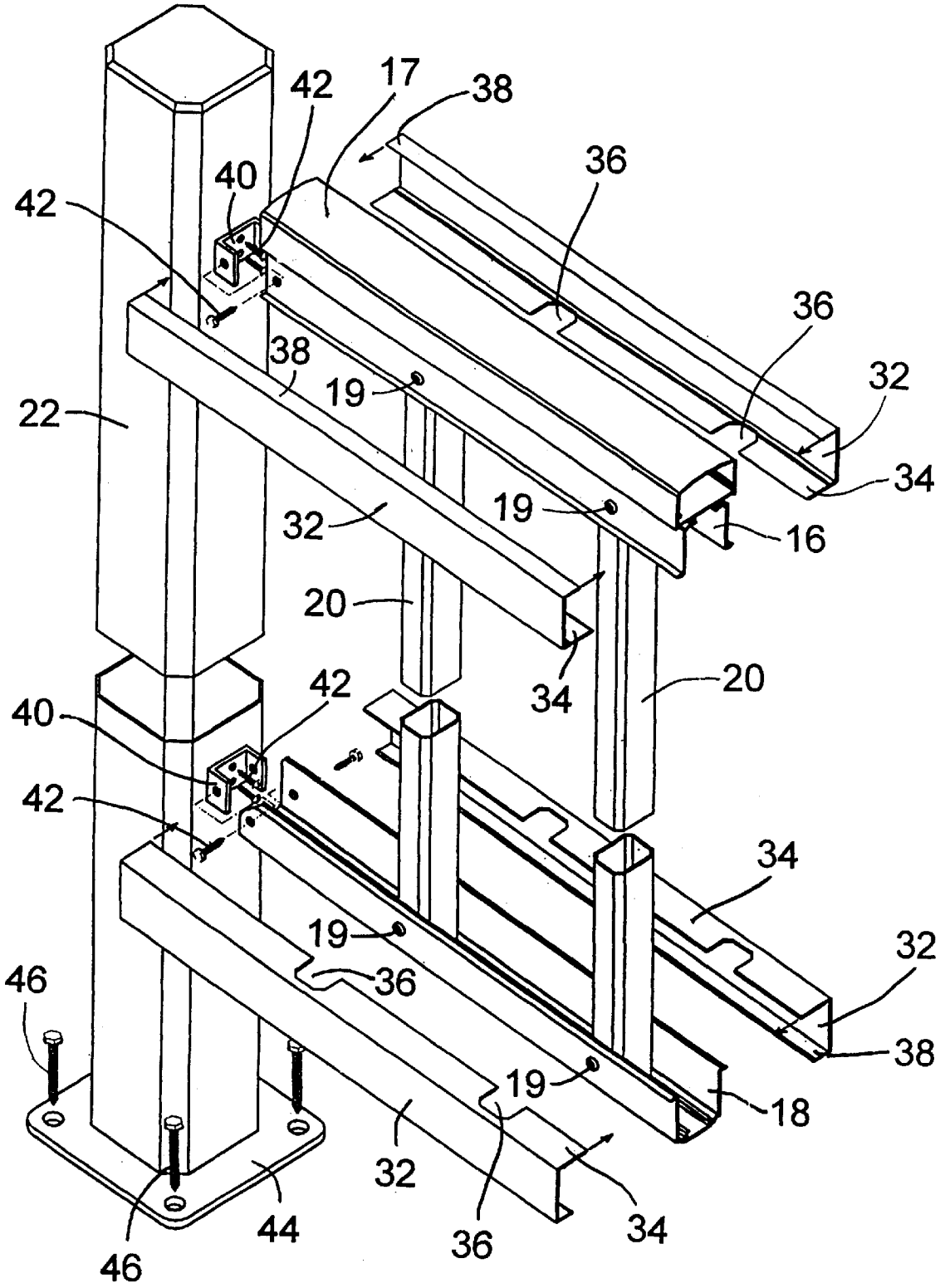
FIG. 3 is a perspective view showing an expanded portion of a railing assembly having spaced apart cross-bars and siding strips in accordance with the present invention.

FIG. 3 illustrates in greater detail one embodiment of the present invention. As shown in this figure, the upper railing 16 and the lower railing 18 are formed with a U-shaped channel. Obviously, the U-shaped channel of the upper railing 16 is in a reverse position when this railing is assembled, i.e. with its opening pointed down. The top portion 17 of railing 16 has a smooth surface suitable to be held by the hand. The ends of cross-bars 20 fit into the U-shaped channels of the upper railing 16 and lower railing 18 and are riveted therein with rivets 19. Cross-bars 20 can be pivoted about rivets 19.

The present invention provides for siding strips 32 which are adapted to be snapped-on and locked on the sides of railings 16 and 18 respectively. These siding strips 32 have inwardly projecting flanges 34 which, when the siding strips are in locked position, will essentially completely cover the openings of the U-shaped channels of railings 16 and 18 respectively. In order to accommodate the spaced apart cross-bars 20, flanges 34 have cutouts 36 which are of a size and shape such as to essentially surround the cross-bars 20 when the siding strips 32 are in their assembled position. A second flange 38 may also be provided on the siding strips 32 to facilitate locking the same. It will be realized that such assembly, when the siding strips 32 are locked on the railings 16 and 18 will cover the opening of the U-shaped channels of railings 16 and 18, thereby preventing dirt, dust and the like to penetrate thereinto. Also it will cover the heads of rivets 19, thereby improving the appearance of the railing assembly.

Such railing assembly may be attached to an end post 22 by means of brackets 40 and screws 42. Post 22 has a base 44 which is connected to the floor by bolts or screws 46.

Figure 4:
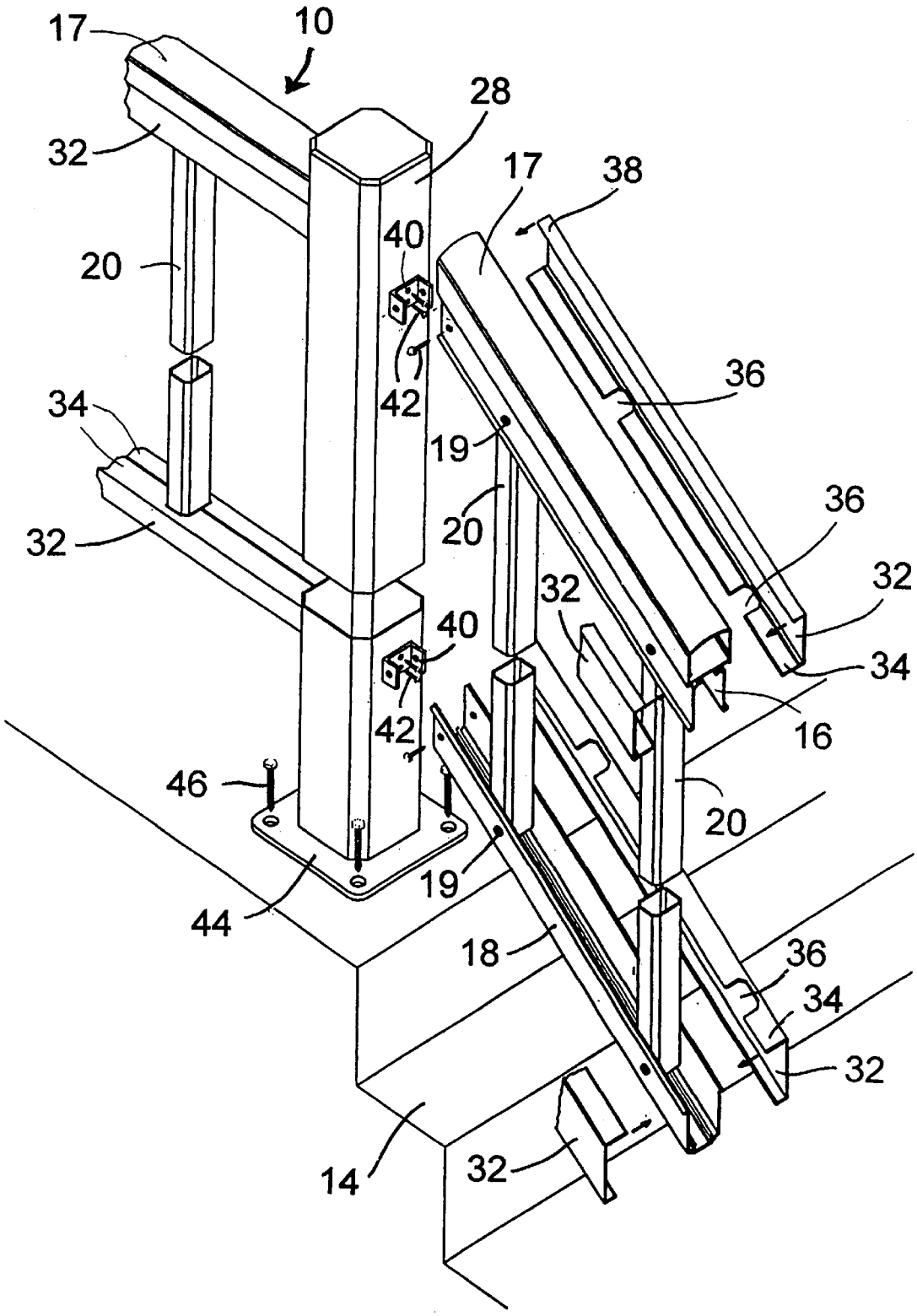
FIG. 4 is a perspective view showing an expanded portion of a railing assembly such as in FIG. 3 but positioned in relation to a stairway.

FIG. 4 shows how the railing assembly 10 looks after it has been assembled as described above with reference to FIG. 3 and wherein flanges 34 essentially completely cover the U-shaped openings of the railings.

Furthermore, in FIG. 4 there is shown an arrangement of the novel railing assembly to be installed in conjunction with a stairway 14. This is done essentially as described above with reference to FIG. 3, but the spaced apart cross-bars 20 are positioned herein at an angle with respect to the upper railing 16 and lower railing 18 which are themselves at an angle to the horizontal that depends on the slope of the stairway 14. This railing assembly is attached to the middle post 28 by brackets 40 and screws 42 and post 28 also has a base 44 affixed to the floor by bolts or screws 46. In this case, cutouts 36 may have to be wider to make allowance for the angular tilt in the cross-bars 20. Initially, all cutouts may be made the same to facilitate manufacture of the siding strips, and they may be enlarged during installation when this becomes required. Tools and instructions may be provided to do just that.

Figure 5:
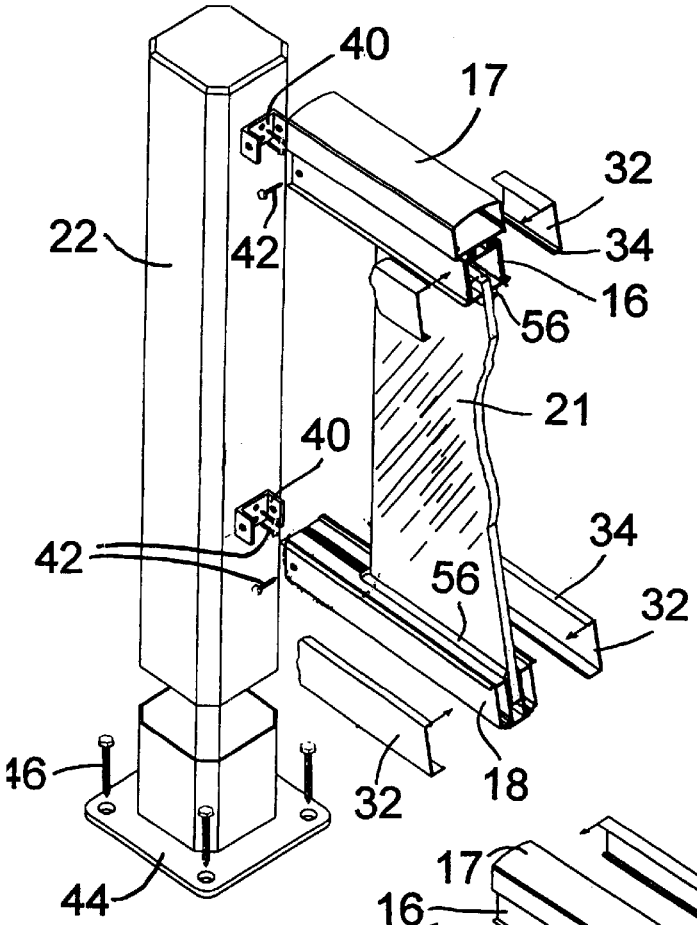
FIG. 5 is a perspective view showing a portion of a railing assembly in accordance with the present invention with a plate between the upper and lower railings.
Figure 6:
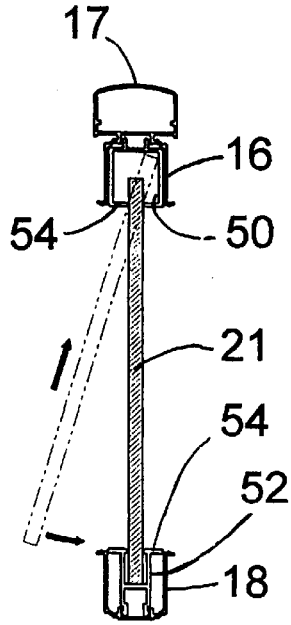
FIG. 6 is a cross-sectional view showing the manner in which a plate is inserted between the railings.
Figure 7:
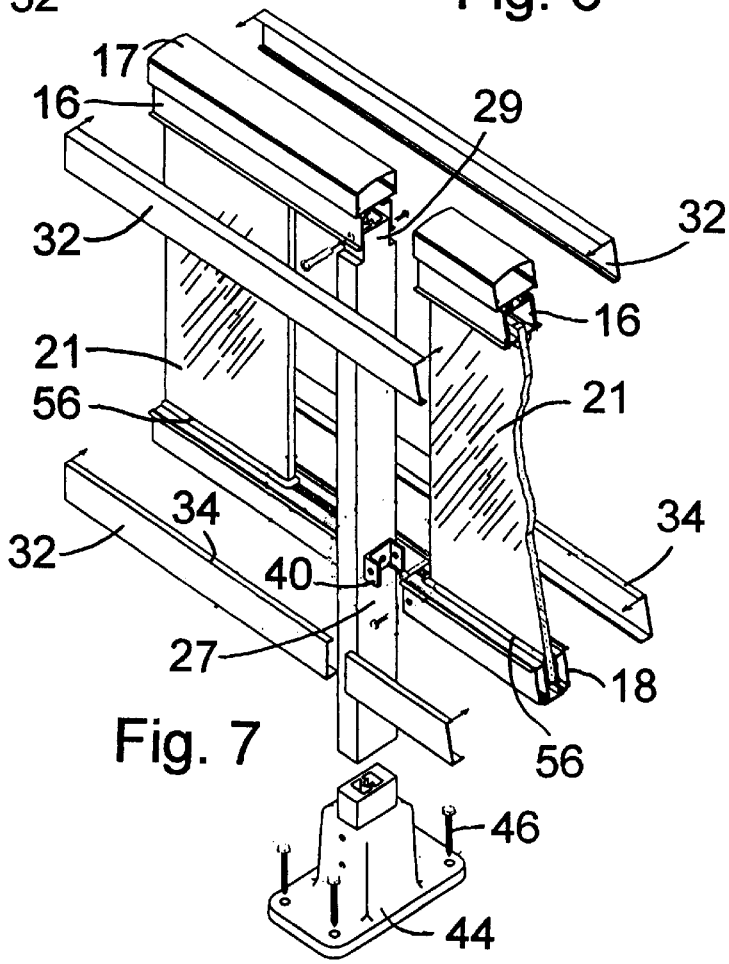
FIG. 7 is another perspective view showing a connection between two sections of a railing assembly such as shown in FIG. 5.

FIG. 5, FIG. 6 and FIG. 7 illustrate another embodiment of the present invention wherein in lieu of cross-bars 20, plates 21 are used between railings 16 and 18. The U-shaped channels of railings 16 and 18 in this embodiment are provided with inserts 50 and 52 (see FIG. 6) adapted to accommodate and snugly hold plate 21. In FIG. 6, it is shown how plate 21 may be inserted into such housing. At the opening end of the U-shaped channel, these inserts 50 and 52 form a ledge 54. Between said ledge 54 and the plate 21, there may be provided a sealing strip 56 that would seal the plates within the U-shaped channels. In lieu of inserts 50 and 52, one could fabricate railings 16 and 18 so that they would contain the desired structure.

As in the previous embodiment, the invention provides siding strips 32 which are snapped-on and locked on the sides of the railings 16 and 18. Here, however, no cutouts in the inwardly projecting flanges 34 are required and these flanges are shorter since they merely need to cover ledges 54 instead of the entire opening of the U-shaped channels. Such covering with the siding strips 32 strengthens the overall structure and enhances the appearance of the railing assembly. It should also be mentioned that siding strips may, if necessary, be removed after being locked onto the sides of the railings by forcing these out of their locked position. This may be needed during repairs to the railing assembly or the like. Thereafter, they may again be snapped-on in and re-locked on the sides of the railings.

In FIG. 5 it is also shown how the railing assembly may be attached to an end post 22 with brackets 40 and screws 42 as already explained with reference to FIG. 3.

On the other hand, middle post 27 shown in FIG. 7 is structured somewhat differently than post 28 of FIG. 4. This is so that its upper end 29 may be used to position railing 16 thereon to provide continuity in the smooth railing surface 17. This, however, is done only if such continuity is desired, otherwise a standard post such as the middle post 26 shown in FIG. 2 can be used. Moreover, middle post 27 could also be used with cross-bars 20 in lieu of post 26 shown in FIG. 1. This could be done by merely replacing one of the bars 20 with such post 27, which can readily be accomplished by cutting a suitable opening in the bottom of the U-shaped channel of railing 18 and inserting the bottom end of post 27 therethrough and connecting it to base 44. It should be noted that such railing assemblies are made in lengths of up to about 5 meters (16 feet) and thus it may be useful to use middle posts such as post 27 to support them without cutting them into sections.

It should finally be noted that the invention is not limited to the embodiments specifically described and illustrated above, but that various modifications obvious to those skilled in the art can be made without departing from the spirit of the invention and the scope of the following claims.

I claim:

1. A railing assembly comprising an upper railing and a lower railing made of a metal, each railing having a longitudinal channel therein; means secured within said channels adapted to interconnect said railings with one another; and a siding strip adapted to be snapped-on and locked laterally on each side of each railing, each said siding strip having an inwardly projecting flange at one of its edges, such that when two siding strips are locked laterally on opposite sides of each railing, their flanges serve to substantially fully cover any opening or ledge of the longitudinal channel.

2. A railing assembly as claimed in claim 1, in which said means adapted to interconnect said railings with one another consist of a plurality of spaced apart cross-bars pivotably fastened at each end to each railing within the longitudinal channel of each railing.

3. A railing assembly as claimed in claim 2, in which the outwardly projecting flange of each siding strip has cutouts in places where said flange meets the cross-bars when the siding strips are locked onto the sides of the railings, said cutouts having a size and shape adapted to surround the cross-bars.

4. A railing assembly as claimed in claim 3, in which the cross-bars are made of a metal and are hollow.

5. A railing assembly as claimed in claim 1, in which said means adapted to interconnect said railings consist of plates the top and bottom ends of which are adapted to be secured within the longitudinal channels of the upper and lower railings respectively.

6. A railing assembly as claimed in claim 5, in which said plates are made of metal, plastic, fiberglass or glass.

7. A railing assembly as claimed in claim 1, in which the upper railing has a smooth upper surface suitable for holding with a hand.

8. A railing assembly according to claim 2, in which said cross-bars are angularly adjustable through their pivotable connections to the railings.

9. A railing assembly as claimed in claim 1, in which the siding strips also have a second flange at the edge opposite to the edge with the flange serving to cover the opening or ledge of the longitudinal channel, said second flange serving to facilitate locking of the siding strips onto the sides of the railings by snap-on action.

10. An aluminum railing assembly comprising: an upper railing and a lower railing made of aluminum, each railing having a generally U-shaped longitudinal channel; a plurality of spaced apart aluminum cross-bars pivotably fastened at each end to each railing within the U-shaped channels; and aluminum siding strips adapted to be snapped-on and locked on each side of each railing, each said siding strip having an inwardly projecting flange such that when two siding strips are locked laterally on opposite sides of each railing, their flanges cooperate to substantially fully cover the opening of the U-shaped channel, said flanges being provided with cutouts in places where said flanges meet the cross-bars when the siding strips are locked laterally onto the sides of the railings, said cutouts having a size and shape adapted to essentially surround the cross-bars.

11. A railing assembly kit comprising:

(a) a structure consisting of an upper railing and a lower railing made of a metal, each railing having a longitudinal channel therein, and a plurality of spaced apart cross-bars also made of a metal, pivotably fastened at each end to each railing within the longitudinal channel of each railing;

(b) siding strips made of a metal, adapted to be snapped on and locked laterally on the sides of the railings, said siding strips having inwardly projecting flanges serving to substantially fully cover the opening of the longitudinal channel when said siding strips are locked laterally on each side of each railing, said flanges having cutouts in places where said flanges meet the cross-bars when the siding strips are locked laterally onto the sides of the railings, said cutouts having a size and shape adapted to surround the cross-bars; and (c) end posts and intermediate posts made of a metal, to which predetermined sections of said structure are adapted to be connected, each of said posts being provided with a base capable of being firmly attached to the floor where the railing assembly is to be installed.

12. A railing assembly kit comprising:

(a) an upper railing and a lower railing made of a metal, each railing having a longitudinal channel therein;

(b) end-posts and intermediate posts made of a metal, to which predetermined sections of said railings are adapted to be connected, each of said posts being provided with a base capable of being firmly attached to the floor where the railing assembly is to be installed;

(c) plates adapted to be inserted by their top and bottom ends into the longitudinal channels of the upper and lower railings respectively to be firmly held therein and thereby interconnect said railings; and (d) siding strips made of a metal, adapted to be snapped-on and locked laterally on each side of each railing, each siding strip having an inwardly projecting flange such that when two siding strips are locked on opposite sides of each railing, their flanges serve to cover side ledges of each longitudinal channel.

13. A railing assembly kit as claimed in claim 11, in which the metal is aluminum.

14. A railing assembly kit as claimed in claim 12, in which the metal is aluminum.

* * * * *